US012708859B2

(12) United States Patent
Makita

(10) Patent No.: US 12,708,859 B2
(45) Date of Patent: Aug. 18, 2026

(54) LOCKING STRUCTURE FOR LOCKING AN OBJECT TO A PACKAGING CONTAINER

(71) Applicant: EPOCH COMPANY, LTD., Tokyo (JP)

(72) Inventor: Shun Makita, Tokyo (JP)

(73) Assignee: EPOCH COMPANY, LTD., Tokyo (JP)

( * ) Notice: Subject to any disclaimer, the term of this patent is extended or adjusted under 35 U.S.C. 154(b) by 0 days.

(21) Appl. No.: 18/931,629

(22) Filed: Oct. 30, 2024

(65) Prior Publication Data

US 2025/0135368 A1 May 1, 2025

(30) Foreign Application Priority Data

Oct. 31, 2023 (JP) ..... 2023-186967

(51) Int. Cl.
*A63H 17/26* (2006.01)
*B65D 5/50* (2006.01)

(52) U.S. Cl.
CPC ..... *A63H 17/264* (2013.01); *B65D 5/50* (2013.01)

(58) Field of Classification Search
CPC ..... A63H 17/26; A63H 17/264; A63H 33/00; B65D 5/42; B65D 5/4204; B65D 5/50; B65D 25/10; B65D 25/102
USPC ..... 206/736, 756, 764, 765
See application file for complete search history.

(56) References Cited

U.S. PATENT DOCUMENTS 3,340,998 A * 9/1967 Wilson ..... A47F 7/146 206/764
3,752,246 A * 8/1973 Sullivan ..... A63H 17/262 180/56
5,411,138 A * 5/1995 Klawiter ..... B65D 25/106 53/410
5,636,746 A * 6/1997 McQueeny ..... B65D 5/64 206/756
5,919,074 A 7/1999 Honda
2005/0145535 A1* 7/2005 Augborne ..... B65D 25/10 206/756

(Continued)

FOREIGN PATENT DOCUMENTS

CN 1287502 A 3/2001
CN 209973098 U 1/2020

(Continued)

OTHER PUBLICATIONS

Deng Gang, et al., "A Brief Discussion on Toy Packaging and Its Value", Journal of Taiyuan Urban Vocational College, 5, May 28, 2013, pp. 188-189.

(Continued)

*Primary Examiner* — Bryon P Gehman
(74) *Attorney, Agent, or Firm* — Faegre Drinker Biddle & Reath LLP

(57) ABSTRACT

A locking structure is provided on an object to be locked for locking the object to be locked to a packaging container. The locking structure includes: a first slit having an elongated shape; two second slits connected at right angles to the first slit; third slits connected at right angles to the respective second slits and extending in a direction so as to face each other; and fourth slits connected at right angles to the respective third slits and extending in a direction away from the first slit.

4 Claims, 6 Drawing Sheets

(56) References Cited

U.S. PATENT DOCUMENTS

2010/0084301 A1 4/2010 Trapp et al.

FOREIGN PATENT DOCUMENTS

| | | |
|---|---|---|
| JP | 3099105 U | 3/2004 |
| JP | 3118253 U | 1/2006 |

OTHER PUBLICATIONS

Office action received for Chinese patent application No. 202411527922.8 mailed on May 29, 2026, 10 pages (4 pages English Translation and 6 pages Original document).

* cited by examiner

LOCKING STRUCTURE FOR LOCKING AN OBJECT TO A PACKAGING CONTAINER

CROSS-REFERENCE TO RELATED APPLICATIONS

This application is based on and claims priority under 35 USC 119 from Japanese Patent Application No. 2023-186967 filed on Oct. 31, 2023, the contents of which are incorporated herein by reference.

TECHNICAL FIELD

The present disclosure relates to a locking structure for locking an object to be locked to a packaging container.

BACKGROUND ART

In the related art, there is a locking structure for locking an object to be locked to a packaging container. The object to be locked is locked to the packaging container by the locking structure and is stored in the packaging container. JP3099105U discloses a potted plant packaging container that locks and stores a potted plant within a packaging container. The packaging container includes a rectangular parallelepiped container body, a plurality of lids provided on the container body so as to be foldable, and locking grooves provided at tip ends of the respective lids for locking a rubber band.

SUMMARY OF INVENTION

The potted plant is locked to the packaging container by locking a rubber band into the locking grooves of the respective lids and wrapping the rubber band around the packaging container. Here, for example, in the case of an open-type packaging container that allows a content stored therein to be clearly visible, if the rubber band or the like, which is a locking member for locking, becomes visible, the appearance may deteriorate. On the one hand, in a case in which the object to be locked is formed to have two holes in a bottom portion of the object to be locked such that the packaging container and the object are locked by causing a binding band to pass through the two holes, the locking work for locking the object to be locked may be complicated, and furthermore, separating the object to be locked from the packaging container after purchase may also be complicated.

An object of the present disclosure is to provide a locking structure that facilitates a work for locking or removing an object to be locked, while ensuring that the object to be locked is locked to a packaging container securely and with a good appearance.

A locking structure according to an aspect of the present disclosure is a locking structure provided on an object to be locked for locking the object to be locked to a packaging container, the locking structure including: a first slit having an elongated shape; two second slits connected at right angles to the first slit; third slits connected at right angles to the respective second slits and extending in a direction so as to face each other; and fourth slits connected at right angles to the respective third slits and extending in a direction away from the first slit.

According to the above aspect, it is possible to provide a locking structure that facilitates a work for locking or removing an object to be locked, while ensuring that the object to be locked is locked to a packaging container securely and with a good appearance.

BRIEF DESCRIPTION OF DRAWINGS

The present disclosure will be described in detail based on the following without being limited thereto, wherein.

DESCRIPTION OF EMBODIMENTS

Figure 1:
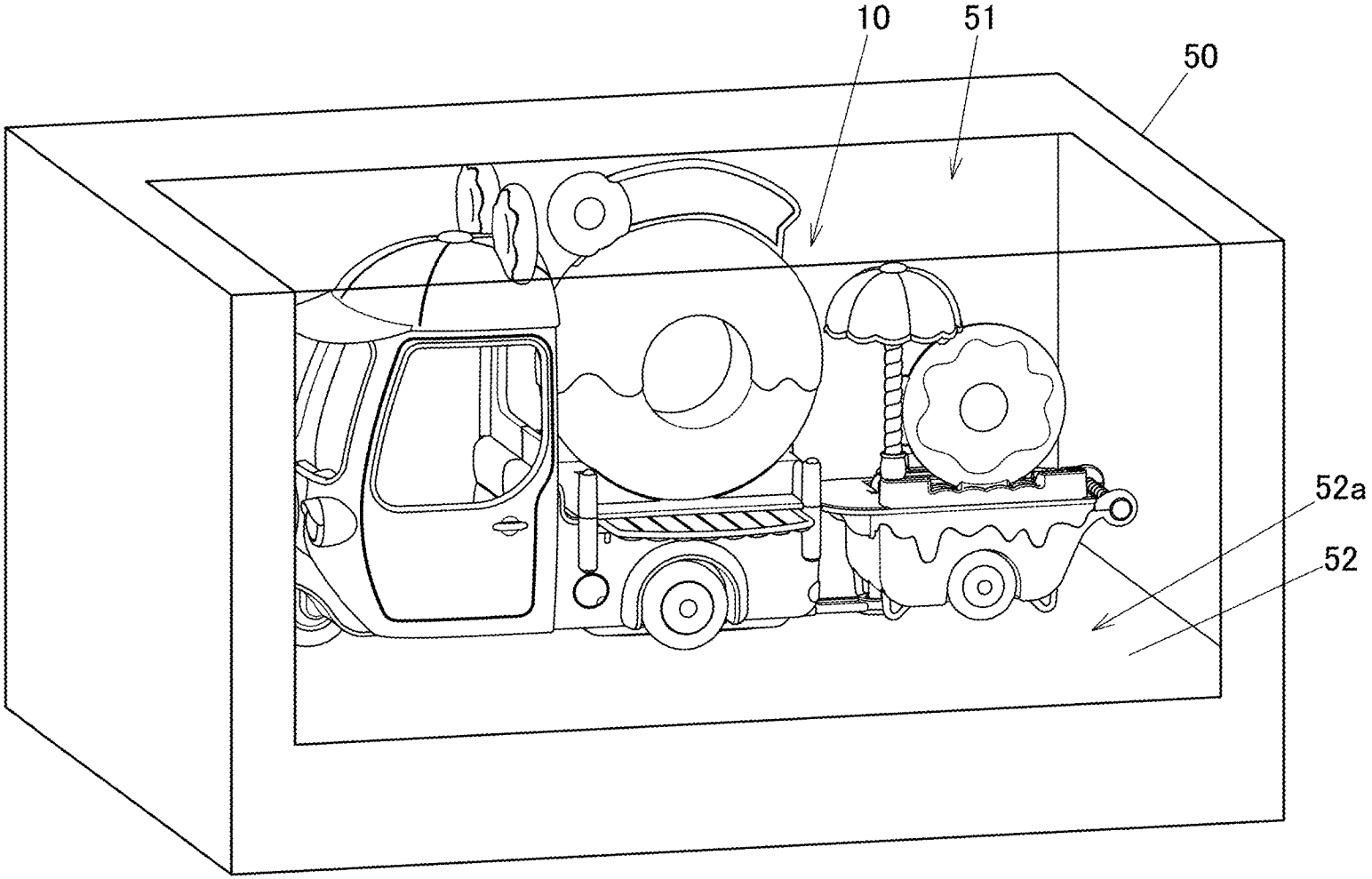
FIG. 1 is a perspective view showing a state in which a traveling toy, which is an object to be locked including a locking structure according to an embodiment of the present disclosure, is locked to a packaging container.

Embodiments of the present disclosure will be described with reference to the drawings. In FIG. 1, an object 10, which is a toy and serves as an object to be locked, is locked to a packaging container 50. The packaging container 50 has an opening 51 on a portion of side and upper surfaces, where a transparent film is provided, allowing contents to be visible. The packaging container 50 has a locking surface 52*a* to which the object 10 is locked. The locking surface 52*a* is an upper surface of a bottom plate 52 of the packaging container 50. Since the object 10 is locked to the locking surface 52*a* of the packaging container 50, movement of the object 10 during transportation or the like is reduced.

Figure 2:
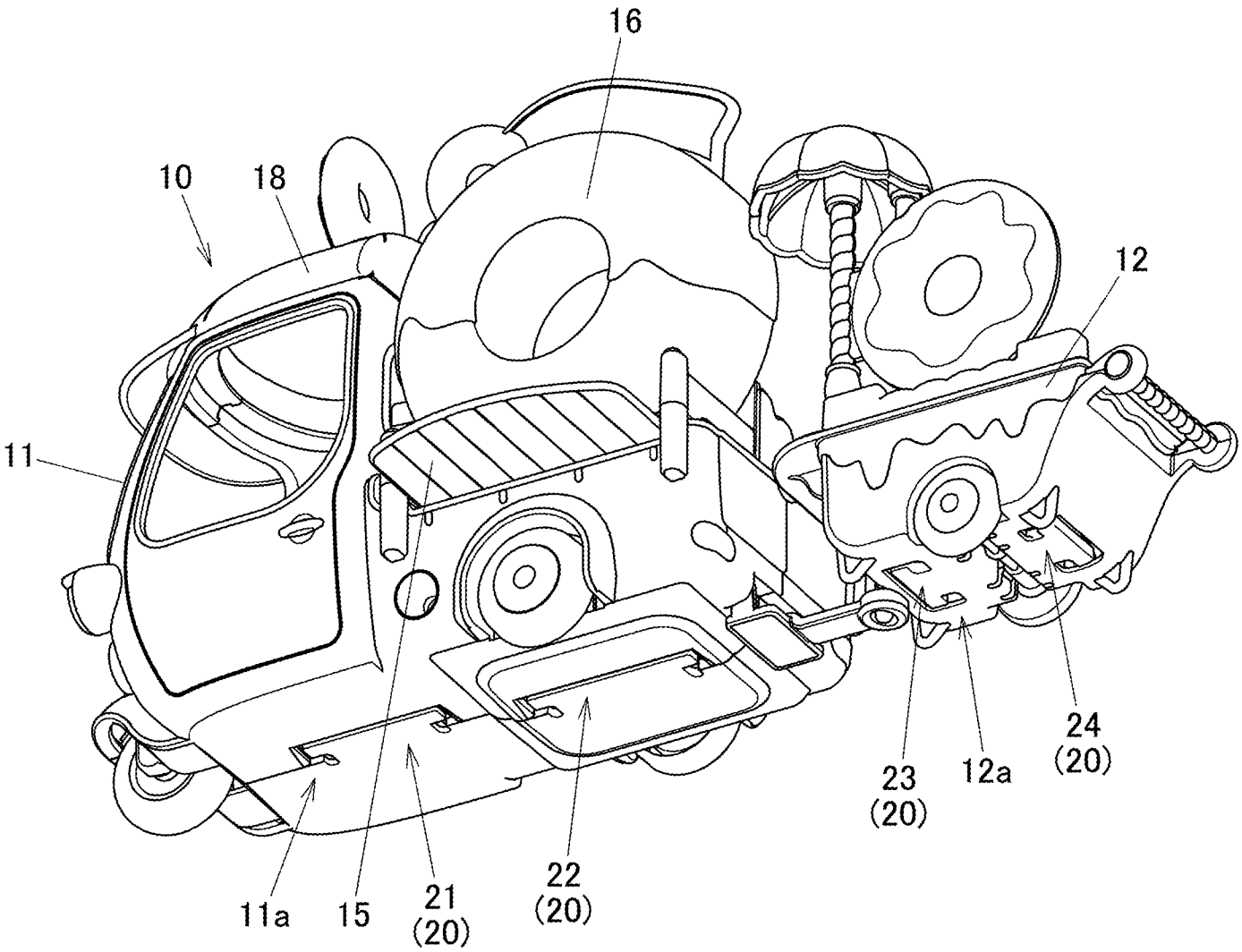
FIG. 2 is a perspective view of the object to be locked including the locking structure according to the embodiment of the present disclosure, as viewed from below.

As shown in FIG. 2, the object 10 includes a first object 11, which is a traveling toy imitating a three-wheeled vehicle and serves as a first object to be locked, and a second object 12, which is a wagon toy towed by the traveling toy that is the three-wheeled vehicle and serves as a second object to be locked. In the traveling toy of the first object 11, auxiliary toys 15 and 16 are detachably attached to a three-wheeled vehicle toy body 18 equipped with a load carrier.

Bottom surfaces 11*a* and 12*a* of the first and second objects 11 and 12 are each provided with two locking structures 20, making a total of four. Among the four locking structures 20, a first locking structure 21 is provided on a front side of the first object 11 (a front side of a traveling toy, which is a three-wheeled vehicle) and a second locking structure 22 is provided on a rear side of the first locking structure 21, and a third locking structure 23 is provided on the second locking body 12, and a fourth locking structure 24 is provided on a rear side of the third locking structure 23.

Figure 3:
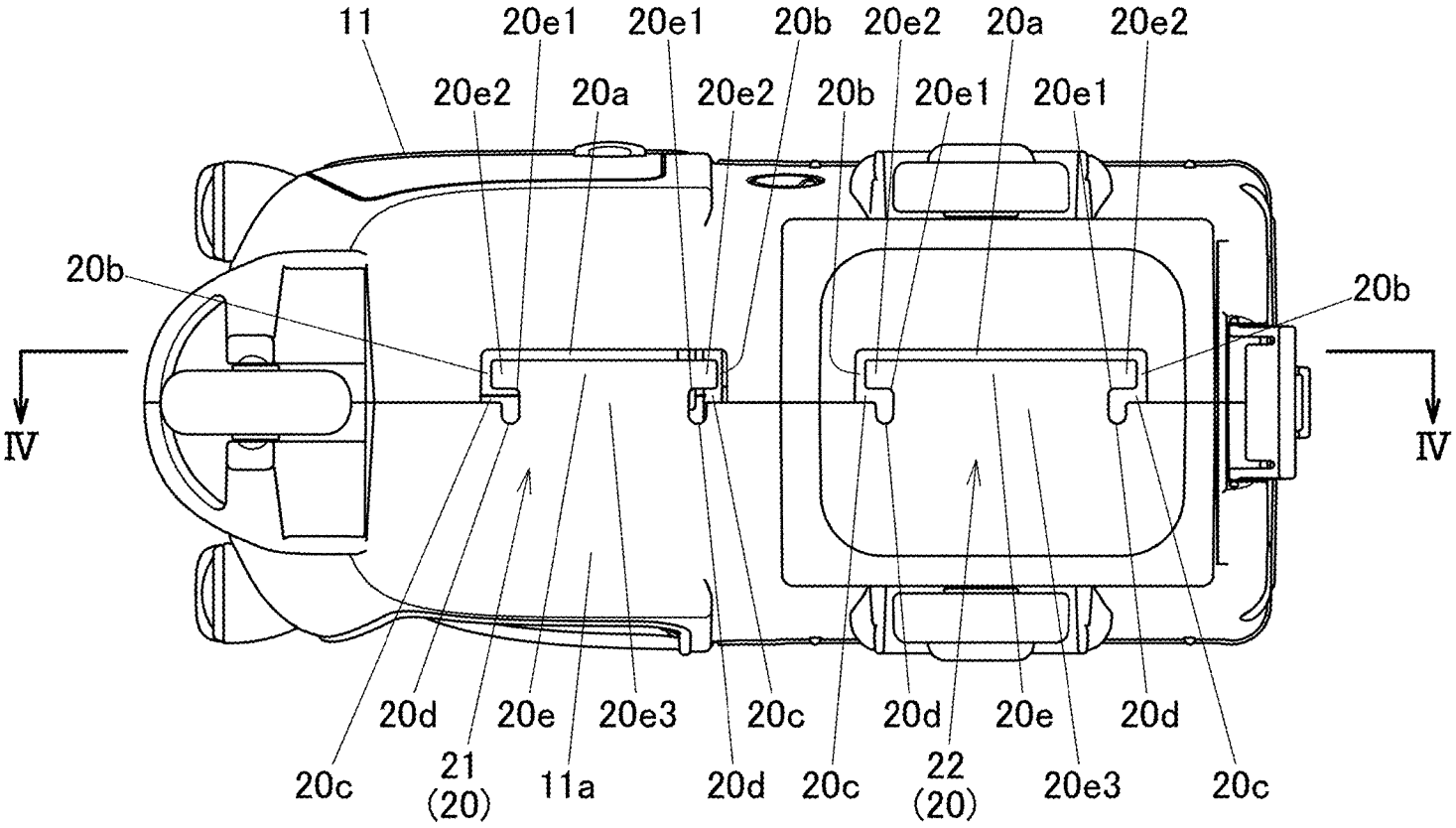
FIG. 3 is a bottom view of the object to be locked including the locking structure according to the embodiment of the present disclosure.

The first locking structure 21 to the fourth locking structure 24 have substantially the same structure. Therefore, in FIG. 3, the locking structure 20 will be described, focusing on the first locking structure 21. The locking structure 20 includes a first slit 20*a* having an elongated shape. Both ends of the first slit 20*a* are provided with two second slits 20*b* connected at right angles to the first slit 20*a* and communicating with the first slit 20*a*.

Third slits 20*c* connected at right angles to the respective second slits 20*b* and extending in a direction facing each other are connected to the respective second slits 20*b*. The second slit 20*b* and the third slit 20*c* are in communication. Fourth slits 20*d* connected at right angles to the respective third slits 20*c* and extending in a direction away from the first slit 20*a* (i.e., a downward direction in FIG. 3) are connected to the respective third slits 20*c*. Each third slit 20*c* and each fourth slit 20*d* are in communication. Therefore, the second slits 20*b*, the third slits 20*c*, and the fourth slits 20*d* on the left and right sides are each in communication via the first slit 20*a*. In addition, the locking structure 20 is symmetrical.

Additionally, the first slit 20*a* and the third slit 20*c* are provided approximately in parallel. The second slit 20*b* and the fourth slit 20*d* are provided approximately in parallel. The first slit 20*a* is formed sufficiently longer than the two second slits 20*b*, the two third slits 20*c*, and the two fourth slits 20*d*. The first slit 20*a*, the two second slits 20*b*, the two third slits 20*c*, and the two fourth slits 20*d* penetrate through the bottom surface 11*a* of the object 10, thereby forming a locking piece 20*e*. The locking piece 20*e* is formed approximately in a T-shape and is provided on the bottom surface 11*a* of the locking body 10.

The locking piece 20*e* has a corner portion 20*e*1 formed by a connecting portion between the third slit 20*c* and the fourth slit 20*d*. Both end portions of the locking piece 20*e*, which are located on outer sides with respect to the corner portions 20*e*1, are configured as protruding pieces 20*e*2. The locking piece 20*e* on a direction side in which the fourth slit 20*d* extends from the corner portion 20*e*1 is configured as a base portion 20*e*3 of the locking piece 20*e*. Additionally, the first slit 20*a* and the second slit 20*b* are formed to have substantially the same width. The third slit 20*c* and the fourth slit 20*d* are formed to have substantially the same width. The first slit 20*a* and the second slit 20*b* are formed to have narrower widths than those of the third slit 20*c* and the fourth slit 20*d*.

Figure 4:
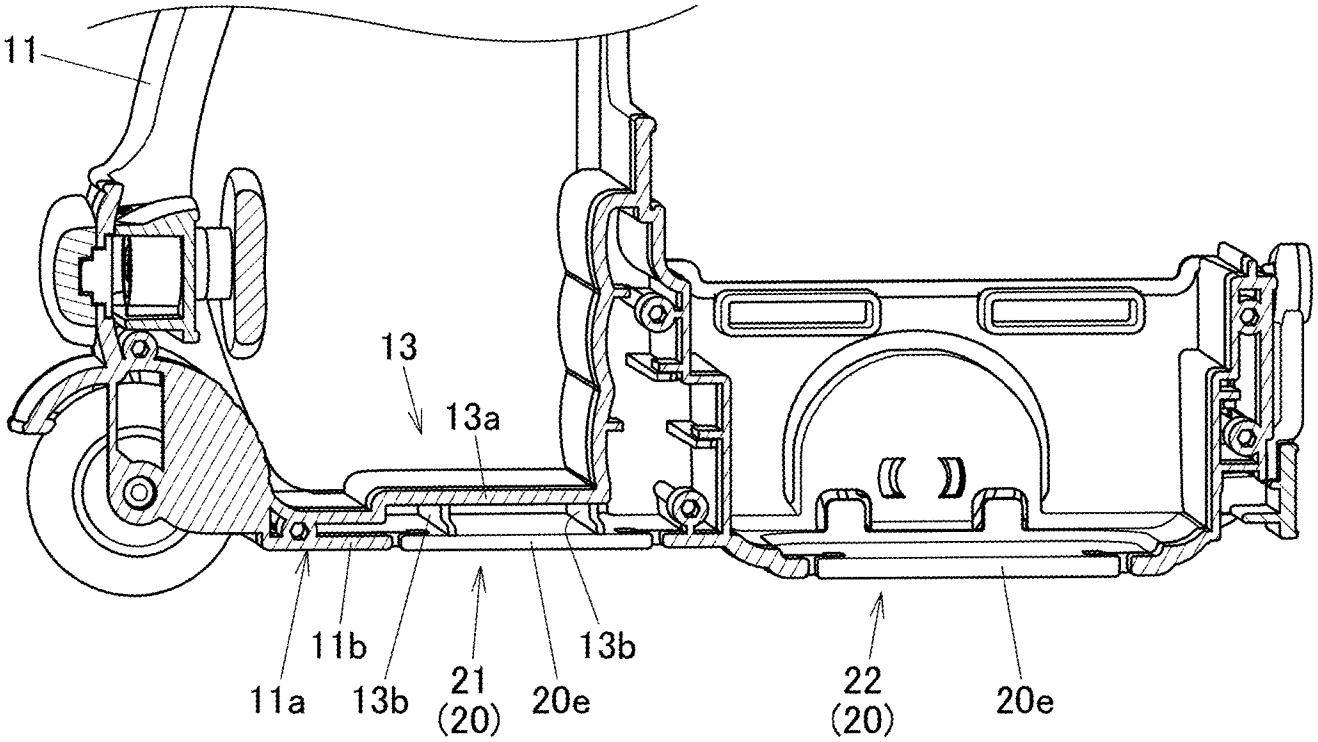
FIG. 4 is a cross-sectional view taken along line IV-IV of FIG. 3, showing the object to be locked including the locking structure according to the embodiment of the present disclosure, where auxiliary toys are omitted.

As shown in FIG. 4, the first slit 20*a*, the two second slits 20*b*, the two third slits 20*c*, and the two fourth slits 20*d* are formed as through holes, but a structure 13 covering the first locking structure 21 is provided above the first locking structure 21. The structure 13 includes a structural plate member 13*a* approximately parallel to a bottom plate 11*b* having the bottom surface 11*a*. The structural plate member 13*a* and the bottom plate 11*b* are spaced therebetween. Two ribs 13*b* are provided between the structural plate member 13*a* and the bottom plate 11*b* to connect the structural plate member 13*a* and the bottom plate 11*b*. The ribs 13*b* are provided over a region ranging from a base end of the locking piece 20*e* to a tip end of the locking piece 20*e*. The ribs 13*b* are provided within a region of the locking piece 20*e* so as not to interfere with the first slit 20*a*, the two second slits 20*b*, the two third slits 20*c*, and the two fourth slits 20*d*. In addition, a portion with a low height, i.e., a portion not connected to the structural plate member 13*a*, is formed to prevent significant interference even when a rubber string, which will be described below, is stretched between the fourth slits 20*d*.

Figure 5:
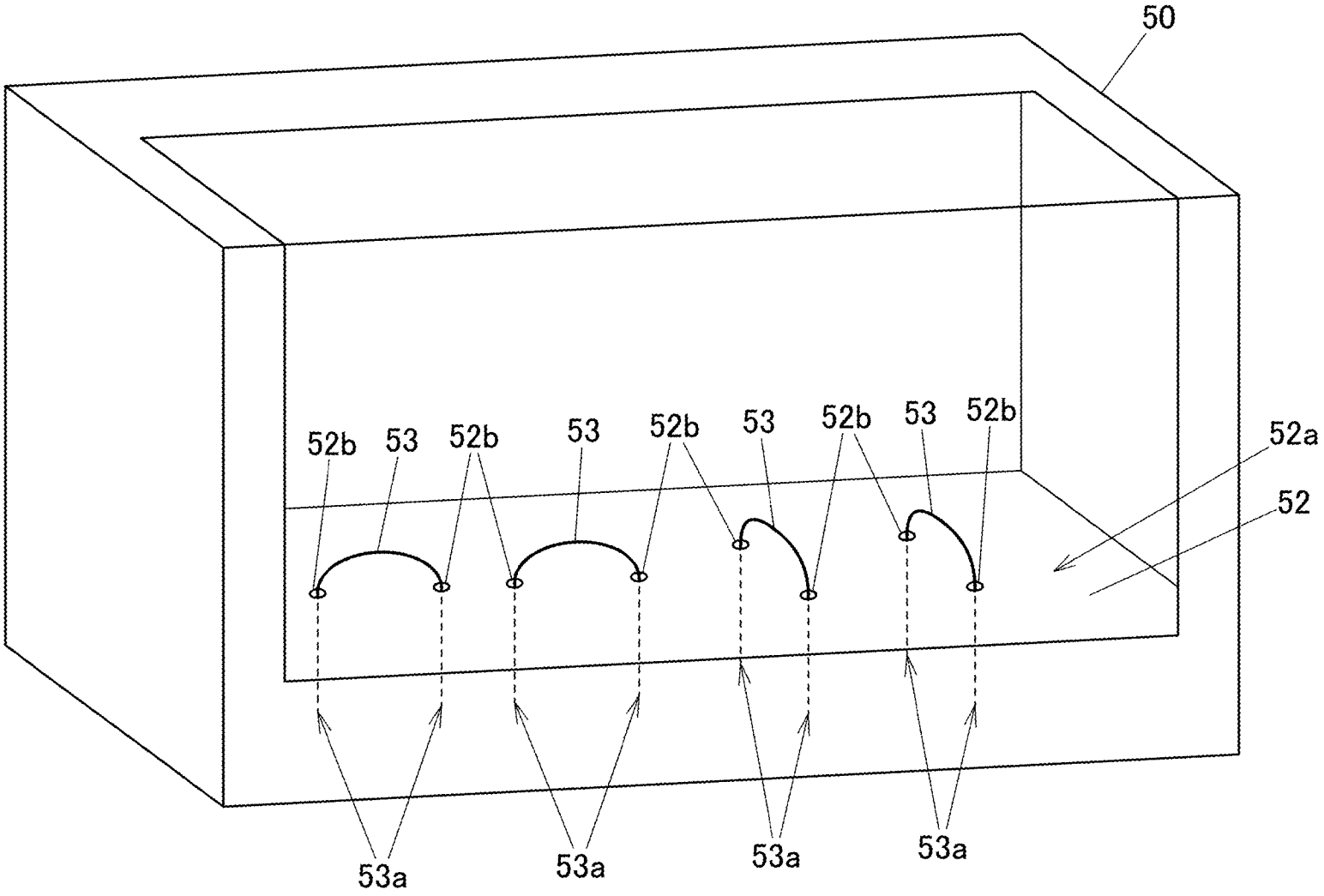
FIG. 5 is an explanatory view for illustrating locking of the object to be locked using the locking structure according to the embodiment of the present disclosure, and is a perspective view showing a state in which rubber strings are provided in the packaging container.

The object 10 is locked to the packaging container 50 as follows. As shown in FIG. 5, a part (the locking surface 52*a* in the present embodiment) of the packaging container 50, to which the object 10 is locked, is provided with annular rubber strings 53, corresponding to each locking structure 20 (the first locking structure 21, the second locking structure 22, the third locking structure 23, and the fourth locking structure 24). The rubber string 53 is provided such that it passes through a pair of through holes 52*b* of the bottom plate 52 from the locking surface 52*a* side and end portions 53*a* are arranged on the lower surface side of the bottom plate 52.

Figure 6:
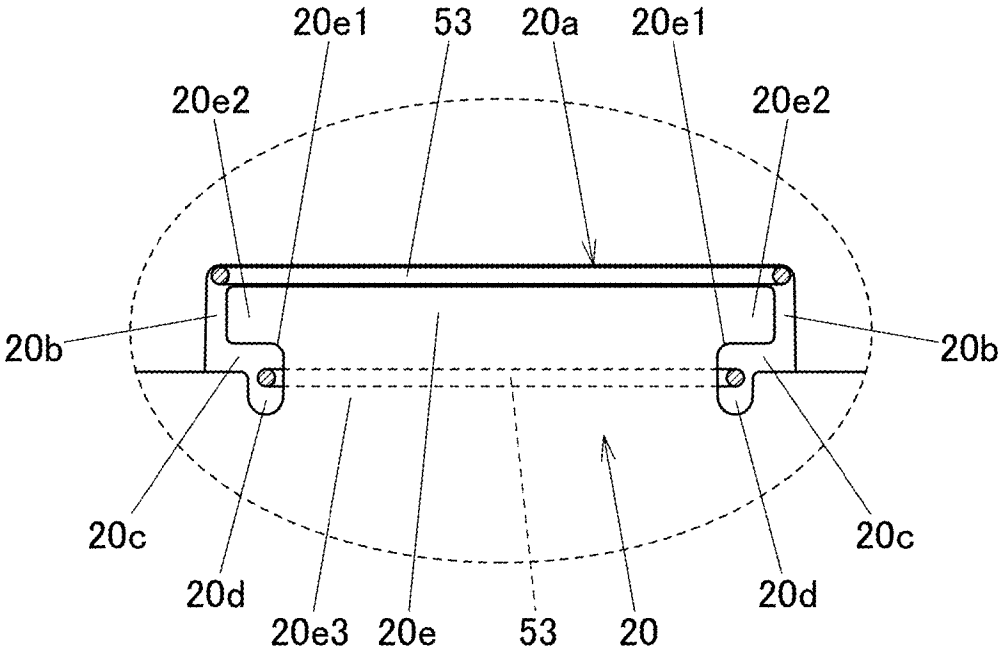
FIG. 6 is an explanatory view for illustrating locking of the object to be locked using the locking structure according to the embodiment of the present disclosure, showing a process of locking a rubber string to the locking structure.

In order to lock the object 10 to the packaging container 50, the rubber string 53 protruding from the bottom plate 52 is locked to each locking structure 20. As shown in FIG. 6, for locking of the rubber string 53 to the locking structure 20, the portion of the rubber string 53 protruding from the bottom plate 52 is first widened to pass through the first slit 20*a*. Then, the rubber string 53 having passed through the first slit 20*a* is moved to the fourth slits 20*d* via the second slits 20*b* and the third slits 20*c*. Then, when the rubber string 53 is placed on the base portion 20*e*3 of the locking piece 20*e*, the end portions 53*a* of the rubber string 53 on the lower surface side of the bottom plate 52 are connected to lock the object 10 to the locking surface 52*a*.

Note that the rubber string 53, which is a string member for locking, may also be another elastic string-like member or a non-elastic string-like member. In addition, by providing a slit between the through holes 52*b*, an annular string member for locking, such as a rubber band, can also be used as the string member for locking.

According to the embodiment of the present disclosure described above, a locking structure of the following aspects can be provided.

A locking structure according to a first aspect is a locking structure provided on an object to be locked for locking the object to be locked to a packaging container, the locking structure including: a first slit having an elongated shape; two second slits connected at right angles to the first slit; third slits connected at right angles to the respective second slits and extending in a direction so as to face each other; and fourth slits connected at right angles to the respective third slits and extending in a direction away from the first slit.

With this configuration, the object to be locked can be easily locked by passing the string member for locking from the first slit to the fourth slits via the second slits and the third slits. In addition, the string member for locking, such as a rubber string, is arranged inside the object to be locked, making it unnoticeable. Therefore, it is possible to provide a locking structure that facilitates a work for locking or removing the object to be locked, while ensuring that the object to be locked is locked to the packaging container securely and with a good appearance.

The locking structure according to a second aspect is provided on a bottom surface of the object to be locked.

With this configuration, the string member for locking can be placed more unnoticeably.

In the locking structure according to a third aspect, the first slit and the second slits are formed to have the same width, the third slits and the fourth slits are formed to have the same width, and the first slit and the second slits are formed to have narrower widths than those of the third slits and the fourth slits. Further, in the locking structure according to a fourth aspect, the first slit, the two second slits, the third slits define a locking piece having a T-shape.

With this configurations, protruding pieces, which are protruding portions of a T-shape of a locking piece surrounded and formed by the respective slits, are formed, resulting in a locking structure that prevents the string member for locking from easily coming off.

Although the embodiments of the present disclosure have been described, the present disclosure is not limited to the above-described embodiments and can be variously changed without departing from the scope of the present disclosure. For example, the first slit 20*a* and the second slit 20*b* are connected at the end portion but may also be connected in the middle of the first slit 20*a*. Similarly, the connection between the second slit 20*b* and the third slit 20*c*, and the connection between the third slit 20*c* and the fourth slit 20*d* may not necessarily be at the end portions. That is, the slits may be formed in any manner as long as the substantially T-shaped locking piece 20*e* is formed; however, when the slits are connected at the end portions of the respective slits, the string member for locking can be passed therethrough smoothly.

What is claimed is:

1. A locking structure provided on an object to be locked for locking the object to be locked to a packaging container, the locking structure comprising:

a first slit having an elongated shape;

two second slits connected at right angles to the first slit;

a respective third slit connected at a right angle to each respective second slit and the third slits extend in a direction so as to face each other; and a respective fourth slit connected at a right angle to each respective third slits and the fourth slits extend in a direction away from the first slit.

2. The locking structure according to claim 1, wherein the locking structure is provided on a bottom surface of the object to be locked.

3. The locking structure according to claim 1, wherein the first slit and the two second slits are each formed to have a same width of each respective slit, wherein the third slits and the fourth slits are each formed to have a same width of each respective slit, and wherein the first slit and the two second slits are formed to have narrower widths than those of the third slits and the fourth slits.

4. The locking structure according to claim 3, wherein the first slit, the two second slits, and the third slits define a locking piece having a T-shape.

* * * * *